US011920296B1

(12) United States Patent
Truesdell

(10) Patent No.: US 11,920,296 B1
(45) Date of Patent: Mar. 5, 2024

(54) KNIFE CUT RESISTANT SLEEVE

(71) Applicant: Buckingham Manufacturing Company, Inc., Binghamton, NY (US)

(72) Inventor: Kevin Truesdell, Binghamton, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 165 days.

(21) Appl. No.: 17/237,101

(22) Filed: Apr. 22, 2021

Related U.S. Application Data

(60) Provisional application No. 63/013,669, filed on Apr. 22, 2020.

(51) Int. Cl.
*D07B 1/16* (2006.01)
*A63B 29/02* (2006.01)

(52) U.S. Cl.
CPC ..... *D07B 1/162* (2013.01); *A63B 29/02* (2013.01); *D07B 2201/2088* (2013.01); *D07B 2201/2091* (2013.01); *D07B 2501/2069* (2013.01)

(58) Field of Classification Search
CPC ..... D07B 1/162; D07B 2201/2083; D07B 2201/2091; D07B 2201/2092; A63B 29/02
See application file for complete search history.

(56) References Cited

U.S. PATENT DOCUMENTS 2,452,047 A * 10/1948 Hamblin ..... F16L 11/24 138/133
3,307,562 A * 3/1967 Corbett ..... A45D 2/2492 132/55
4,347,090 A * 8/1982 Anderson ..... F16L 9/121 428/36.1
4,713,858 A * 12/1987 Kelber ..... A47L 5/14 56/DIG. 8
4,763,883 A * 8/1988 Crabtree ..... B29C 53/665 264/103
5,201,598 A * 4/1993 Tehan ..... E04H 15/60 403/372
5,529,545 A * 6/1996 Isshiki ..... F16G 1/28 474/267
5,752,459 A * 5/1998 Rexroad ..... D04C 1/06 112/440
6,168,496 B1 * 1/2001 Thomas ..... A63H 3/04 112/63
7,147,528 B2 * 12/2006 Arias ..... B63C 9/08 441/131

(Continued)

OTHER PUBLICATIONS

How Cheap Can You Make It?, https://www.allaboutlean.com/how-cheap-can-you-make-it/ (Year: 2018).*

*Primary Examiner* — Shaun R Hurley

(74) *Attorney, Agent, or Firm* — Bond, Schoeneck & King, PLLC; Frederick J. M. Price

(57) ABSTRACT

Embodiments of the knife cut resistant sleeve comprise a spring enclosed by a cut resistant material. The knife cut resistant sleeve is configured to be placed onto a rope of varying sizes and protect the rope from sharp objects. Embodiments of the knife cut resistant sleeve use cut resistant material and can be capable of rotation when hit by a knife in order to prevent the rope from being cut. The sleeve is configured to provide the correct amount of coverage on the rope depending on the length of the rope.

15 Claims, 6 Drawing Sheets

(56) References Cited

U.S. PATENT DOCUMENTS

| | | | | |
|---|---|---|---|---|
| 8,245,668 | B1 * | 8/2012 | Alberti | A47C 31/11 297/228.12 |
| 2016/0129646 | A1 * | 5/2016 | Cadogan | B29C 33/505 425/389 |
| 2016/0304177 | A1 * | 10/2016 | Skipworth | B63C 9/08 |
| 2021/0308529 | A1 * | 10/2021 | Summers | A63B 29/027 |

* cited by examiner

KNIFE CUT RESISTANT SLEEVE

REFERENCE TO RELATED APPLICATIONS

This application claims priority to U.S. Provisional Patent Application Ser. No. 63/013,669, filed on Apr. 22, 2020 and entitled "Knife Cut Resistant Sleeve" the entirety of which is incorporated here in.

BACKGROUND

The present disclosure relates generally to protective equipment. More particularly, to a protective sleeve for climbing equipment.

There are many instances where climbers such as arborists, utility linemen, and rescue workers, will need to use a knife or other sharp object while wearing or using climbing equipment. Specifically, when rescue workers are performing a pole top rescue. In that situation, a rescue worker may be helping an injured climber who is stuck at a high elevation on a pole or tree. To release the climber, the rescue worker often needs to cut the climber's equipment without damaging their own equipment. The ability to protect the rescue worker's equipment from being inadvertently cut would protect the safety of both the rescue worker and the climber. While there are some devices that protect climbing equipment from abrasion, there is nothing to protect the equipment from a laceration or penetration by a knife. Furthermore, conventional devices do not automatically adjust for size and cause the equipment to be left exposed and vulnerable to an accidental cut.

Description of the Related Art Section Disclaimer: To the extent that specific patents/publications/products are discussed above in this Description of the Related Art Section or elsewhere in this disclosure, these discussions should not be taken as an admission that the discussed patents/publications/products are prior art for patent law purposes. For example, some or all of the discussed patents/publications/products may not be sufficiently early in time, may not reflect subject matter developed early enough in time and/or may not be sufficiently enabling so as to amount to prior art for patent law purposes. To the extent that specific patents/publications/products are discussed above in this Description of the Related Art Section and/or throughout the application, the descriptions/disclosures of which are all hereby incorporated by reference into this document in their respective entirety(ies).

SUMMARY

To solve the above-mentioned problems, embodiments of the knife cut resistant sleeve are adapted to fit around and protect ropes of climbing equipment such as wood pole fall restriction devices, secondary lanyards, positioning devices, lifelines, or other equipment. Embodiments of the knife cut resistant sleeve use cut resistant material and are capable of rotation when hit by a knife in order to prevent the rope from being cut. The sleeve can fit around ropes of multiple different lengths and diameters. Further, some embodiments have a spring within the sleeve to allow the sleeve to provide the correct amount of coverage on the rope, such that the sleeve extends when the rope is lengthened or compresses when the rope is let in.

BRIEF DESCRIPTION OF THE DRAWINGS

The present invention will be more fully understood and appreciated by reading the following Detailed Description in conjunction with the accompanying drawings. The accompanying drawings illustrate only typical embodiments of the disclosed subject matter and are therefore not to be considered limiting of its scope, for the disclosed subject matter may admit to other equally effective embodiments.

Reference is now made briefly to the accompanying drawings, in which.

DETAILED DESCRIPTION

Aspects of the present invention and certain features, advantages, and details thereof, are explained more fully below with reference to the non-limiting examples illustrated in the accompanying drawings. Descriptions of well-known structures are omitted so as not to unnecessarily obscure the invention in detail. It should be understood, however, that the detailed description and the specific non-limiting examples, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure.

Figure 1A:
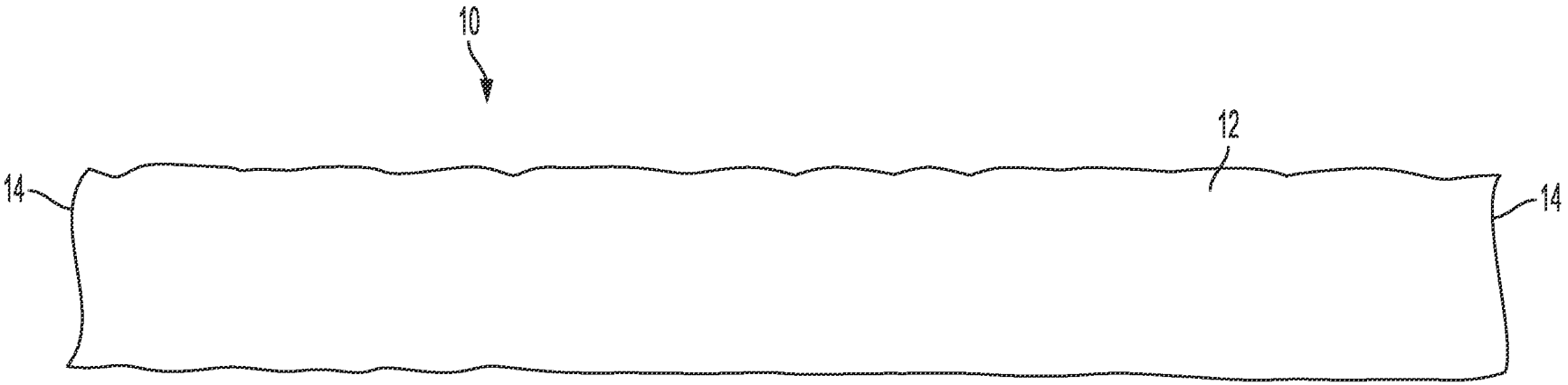
FIG. 1(A) is a perspective view of an example of a knife cut resistant sleeve.
Figure 1B:
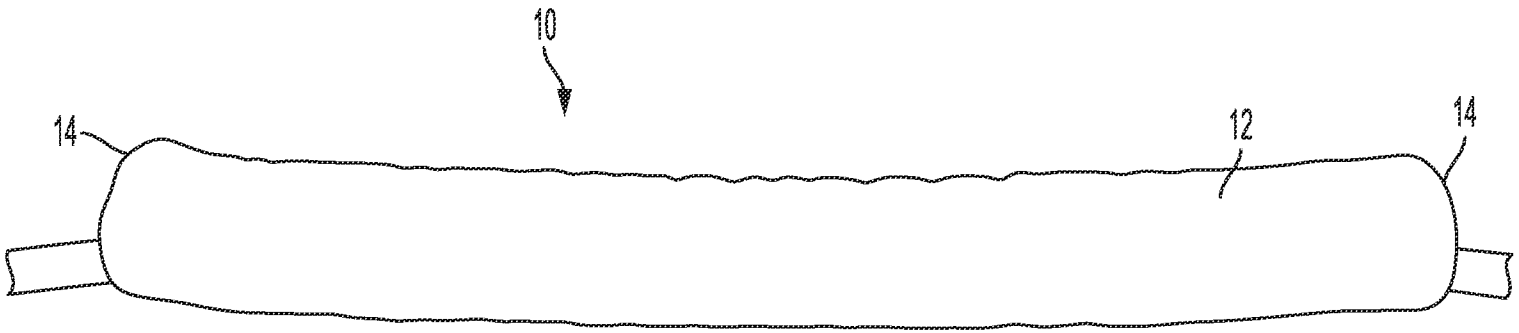
FIG. 1(B) is a perspective view of an example of a knife cut resistant sleeve.

In FIG. 1(A) there is shown a perspective view of an example of a knife cut resistant sleeve. The sleeve, referred to generally by reference numeral 10, comprises cut resistant material 12 and spring 16 (not shown). In FIG. 1(B) there is shown a perspective view of another example of a knife cut resistant sleeve. Sleeve 10 is configured to be slid onto a rope such that sleeve 10 surrounds at least a portion of the rope.

Cut resistant material 12 is sewn together to form a hollow canal and comprises an opening on each end of the material 12. The material 12 can be of any length and diameter suitable in the art such that it can cover spring 16. In one embodiment length of material 12 is longer than spring 16 in when the spring 16 is in its neutral state material 12 is bunched up on spring 16 such that when spring 16 is extended material 12 can still cover the full length of spring 16. It is also possible that when spring 16 is compressed material 12 will bunch up on spring 16. In another embodiment material 12 can have elastic properties which allow the material 12 to complexly cover spring 16 in its neutral state and extend when the spring is extended or bunch when the spring 16 is compressed. In an alternate embodiment where the material 12 has elastic properties the material 12 could be stretched to a degree to fit over the spring 16 when the spring 16 is in its neutral state and bunch less or not at all when the spring 16 is compressed. The cut resistant material 12 may be slightly larger in diameter or elastic enough that it can cover spring 16.

The cut resistant material 12 can be comprised of any number of layers of material. In one embodiment cut resistant material 12 has one layer of material. However, in another example, cut resistant material 12 has two or more layers. The material 12 can be any suitable material as should be known in the art in conjunction with this disclosure which can prevent a knife or other sharp object from penetrating the material 12. In one example the cut resistant material 12 is woven webbing, however it could also be accomplished by chain mail or any other cut resistant material 12. In one embodiment material 12 has tabs sewn into it to secure itself to spring 16. These tabs can be on the ends of the material 12 near the opening such that they are configured to enclose the ends of the spring 16. Alternatively, these tabs can be located at other positions along the length of the material 12. The tabs can be formed by folding the ends of the material 12 inward to form a pocket. In another embodiment the material can be loosely disposed of around the spring or secured by other means such as flaps, glue, or any other suitable mechanism.

Figure 2A:
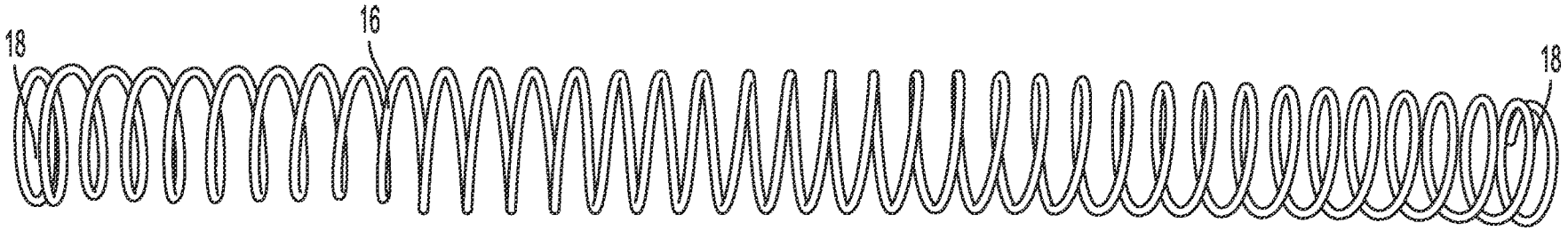
FIG. 2(A) is a perspective view of an example of a spring.
Figure 2B:
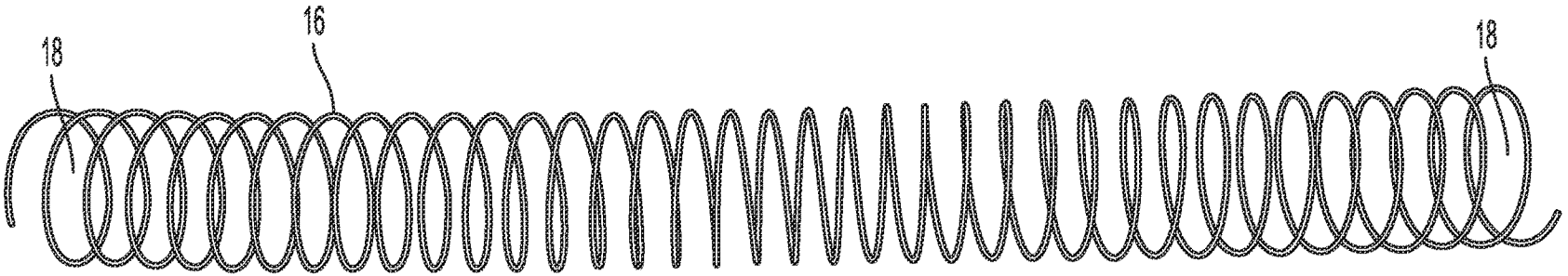
FIG. 2(B) is a perspective view of an example of a spring.

In FIGS. 2(A) and 2(B) there are shown an examples of spring 16. Spring 16 is designed to be enclosed by material 12. Spring 16 has an interior surface which forms a hollow canal and has openings 18 which correspond to openings 14. Spring 16 can be of any suitable shape such that there is an opening 18 on each end and the hollow canal between openings 18. In the examples depicted the spring is a circular spring with uniform coils however in another example, the spring could be any shape such as rectangular or oval and the coils could be ununiformed such as tapered.

The outer surface of spring 16 is at least partially covered by material 12. Spring 16 and material 12 together form sleeve 10 which is capable of accepting and protecting a rope. Spring 16 can be metal, or any suitable material as should be known in the art. Spring 16 can be extended to cover more of the rope when the rope is extended, in the extended state the material 12 will also extend. The spring 16 compresses to cover a shorter length of rope when the rope is let in, similarly the material 12 will compress with the spring 16. Spring 16 can be elastic such that it returns its neutral state when not being actively stretched or compressed. In another example, spring 16 would have little to no elastic characteristics such that a user would be able to manually stretch or compress spring 16 to the desired length and it would retain that length until the user adjusted it. In another embodiment, sleeve 10 will adjust in length as the rope is let in or extended.

Figure 3:
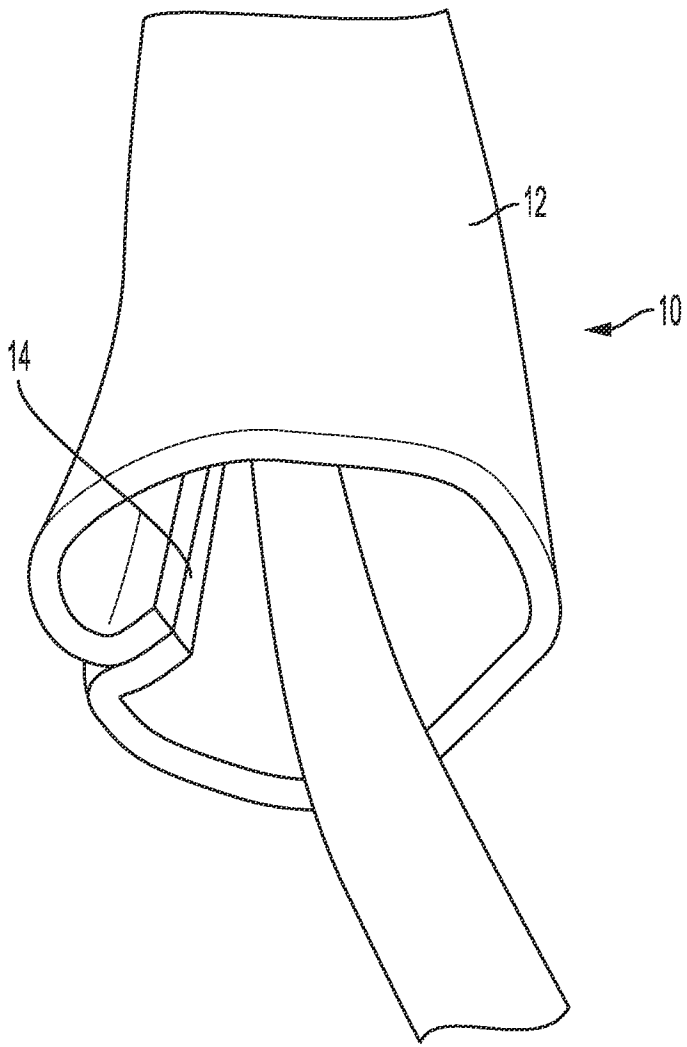
FIG. 3 is a close-up view of an example of a knife cut resistant sleeve.

Referring now to FIG. 3, in use a user can apply sleeve 10 to a rope, portion of a rope, or other equipment through one of the openings 14 and out the opposite opening 14. When the rope is inserted, sleeve 10 fits around and encircles the rope such that it can slide and rotate along the rope but will not fall off. Sleeve 10 can fit loosely or securely on the rope.

Figure 4:
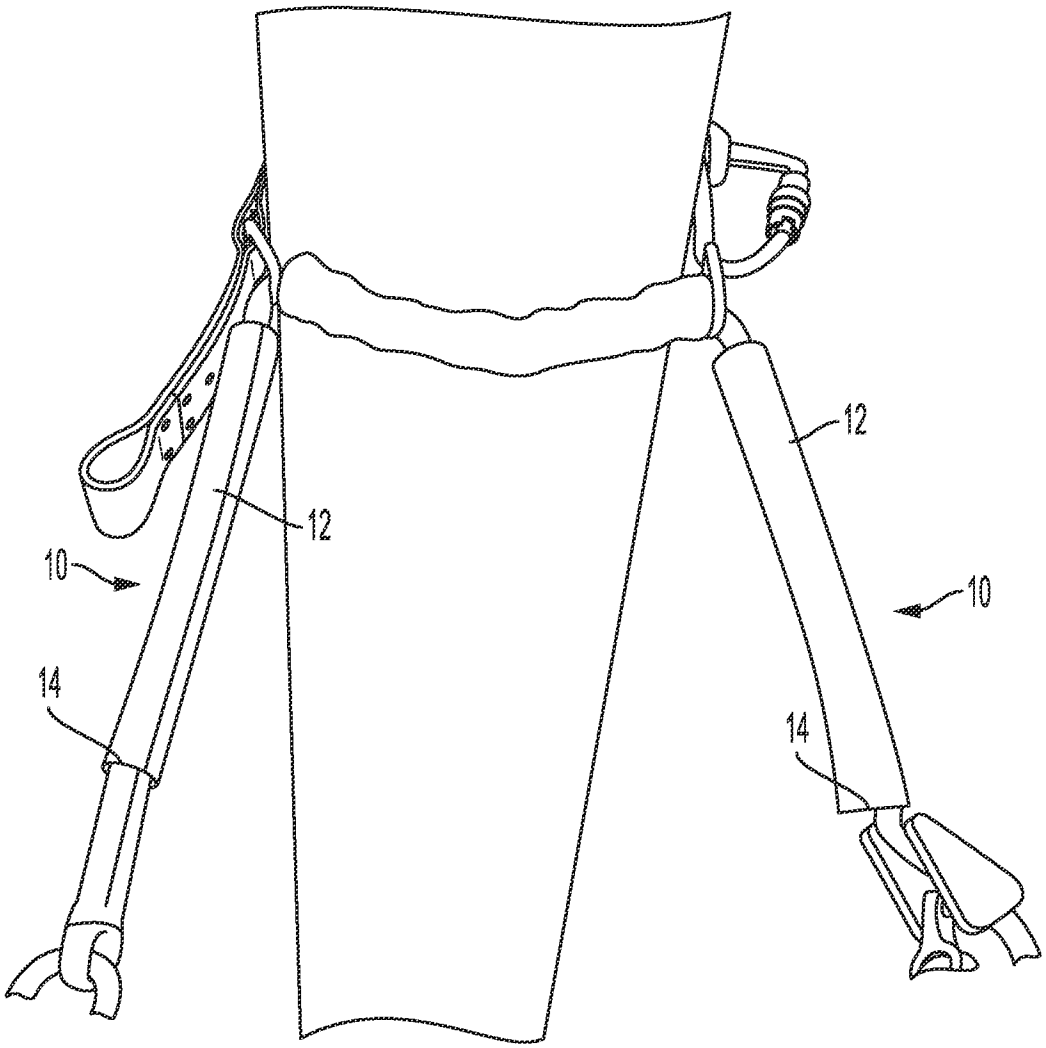
FIG. 4 there is shown a perspective view of an example of a knife cut resistant sleeve in use on a wood pole fall restriction device.
Figure 5:
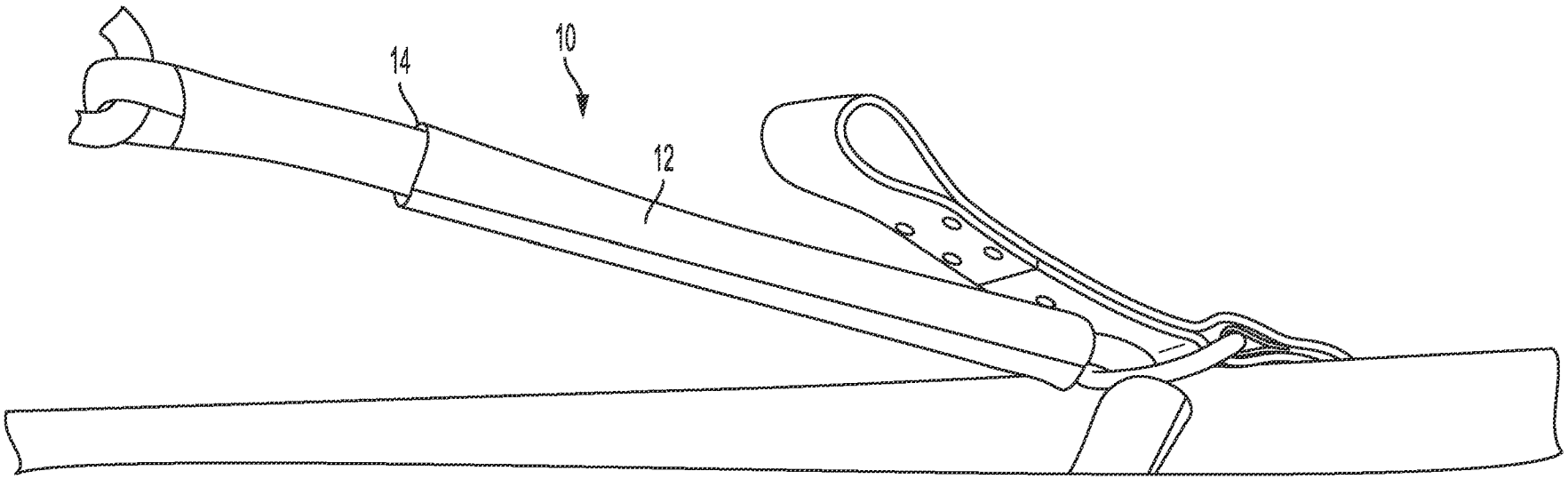
FIG. 5 there is shown a close-up view of an example of a knife cut resistant sleeve in use on a wood pole fall restriction device.

In FIG. 4 there is shown examples of two sleeves 10 in use on a wood pole fall restriction device. As shown, there can be multiple sleeves 10 used at once. In the example on the right, sleeve 10 fully covers the length of the rope between the pole the user is climbing, and the hardware attached to the user. In the example on the left, sleeve 10 only partially covers that portion of the rope. In FIG. 5 there is shown a close-up view of an example of the sleeve in use on a wood pole fall restriction device. Sleeve 10 protects the covered portion of the rope from knives and other sharp objects capable of cutting the rope. Sleeve 10 can be assembled onto a new products or retro fitted in the field, this allows the user to use it when they need it and take it off when they don't. When a knife hits the sleeve, the sleeve rotates. The rotating motion helps prevent the knife from cutting through the sleeve and helps keep the knife edge from contacting the rope. The rotation and the cut resistant material 12 act in conjunction to protect the rope.

Figure 6:
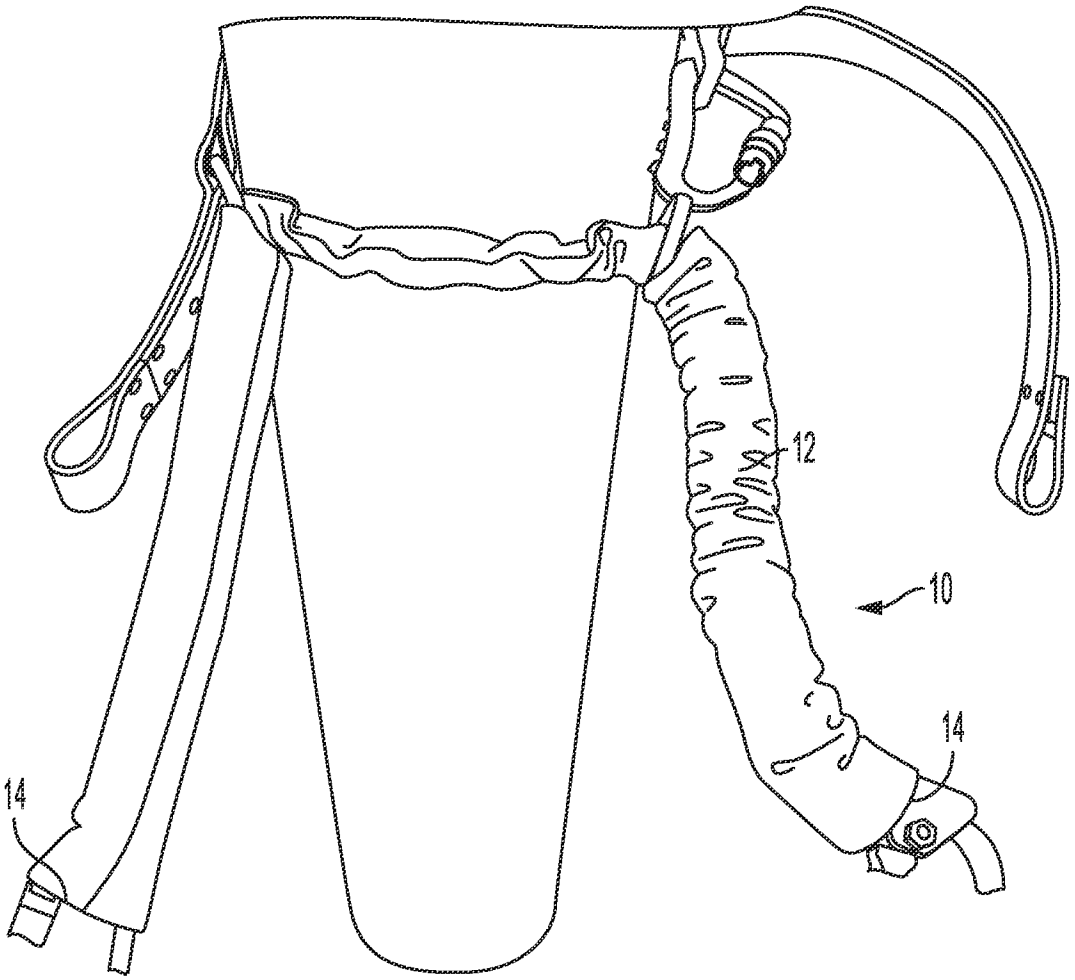
FIG. 6 there is shown a perspective view of an example of a knife cut resistant sleeve in use on a wood pole fall restriction device.

Sleeve 10 can be made in any length and diameter. FIG. 6 depicts two examples of larger sleeves 10 in use on a wood pole fall restriction device. These examples have a larger diameter and longer length than the examples depicted in FIGS. 4-5 and are capable of covering more of the climbing equipment and able to also go over the hardware.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as, "has" and "having"), "include" (and any form of include, such as "includes" and "including"), and "contain" (any form of contain, such as "contains" and "containing") are open-ended linking verbs. As a result, a method or device that "comprises", "has", "includes" or "contains" one or more steps or elements. Likewise, a step of method or an element of a device that "comprises", "has", "includes" or "contains" one or more features possesses those one or more features but is not limited to possessing only those one or more features. Furthermore, a device or structure that is configured in a certain way is configured in at least that way, but may also be configured in ways that are not listed.

The corresponding structures, materials, acts and equivalents of all means or step plus function elements in the claims below, if any, are intended to include any structure, material or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the present invention for various embodiments with various modifications as are suited to the particular use contemplated.

What is claimed is:

1. A knife cut resistant sleeve for protecting a portion of a rope, the knife cut resistant sleeve comprising:

a spring having an outer surface, an inner surface defining a canal, and an opening, the opening and canal being sized and shaped to receive a portion of a rope, wherein the spring is moveable between a neutral state, a compressed state, and an extended state; and a cut resistant material disposed around the outer surface of the spring having an opening which corresponds to the opening of the spring, wherein the cut resistant material has a longer length than a length of the spring in the extended state and is configured to move with the spring between the neutral state, the compressed state, and the extended state.

2. The knife cut resistant sleeve of claim 1, wherein the spring will remain in the compressed state or the extended state until a force returns the spring to the neutral state.

3. The knife cut resistant sleeve of claim 1, wherein the spring is elastic such that when the spring is moved to the compressed state it will bounce back to the neutral state unless there is a force upon it.

4. The knife cut resistant sleeve of claim 1, wherein the cut resistant material is webbing.

5. The knife cut resistant sleeve of claim 1, wherein the cut resistant material is elastic.

6. The knife cut resistant sleeve of claim 1, wherein the cut resistant material is comprised of two layers of material.

7. The knife cut resistant sleeve of claim 1, further comprising a tab attached to the cut resistant material to secure the spring.

8. The knife cut resistant sleeve of claim 7, wherein the tab is attached to the spring.

9. A knife cut resistant sleeve for protecting a portion of a rope, the knife cut resistant sleeve comprising:

a spring having an outer surface, an inner surface defining a canal, and an opening, the opening and canal being sized and shaped to receive a portion of a rope, wherein the spring is moveable between a neutral state, a compressed state, and an extended state;

a cut resistant material disposed around the outer surface of the spring having an opening which corresponds to the opening of the spring, wherein the cut resistant material has a longer length than a length of the spring in the extended state and is configured to move with the spring between the neutral state, the compressed state, and the extended state; and a tab attached to the cut resistant material to secure the spring.

10. The knife cut resistant sleeve of claim 9, wherein the tab is attached to the spring.

11. The knife cut resistant sleeve of claim 9, wherein the spring will remain in the compressed state or the extended state until a force returns the spring to the neutral state.

12. The knife cut resistant sleeve of claim 9, wherein the spring is elastic such that when the spring is moved to the compressed state it will bounce back to the neutral state unless there is a force upon it.

13. The knife cut resistant sleeve of claim 9, wherein the cut resistant material is webbing.

14. The knife cut resistant sleeve of claim 9, wherein the cut resistant material is elastic.

15. The knife cut resistant sleeve of claim 9, wherein the cut resistant material is comprised of two layers of material.

* * * * *